US010434799B2

(12) United States Patent
Runckel et al.

(10) Patent No.: US 10,434,799 B2
(45) Date of Patent: Oct. 8, 2019

(54) SYSTEMS AND METHODS FOR REDUCING BANDING ARTEFACTS OF AN IMAGE ON A SUBSTRATE

(71) Applicant: FabricZoom, LLC, Beaverton, OR (US)

(72) Inventors: Charles James Runckel, Beaverton, OR (US); Ryan Nguyen, Beaverton, OR (US); Hue Phuoc Le, Beaverton, OR (US)

(73) Assignee: FABRICZOOM, LLC, Beaverton, OR (US)

( * ) Notice: Subject to any disclaimer, the term of this patent is extended or adjusted under 35 U.S.C. 154(b) by 0 days.

(21) Appl. No.: 15/986,431

(22) Filed: May 22, 2018

(65) Prior Publication Data

US 2018/0354277 A1 Dec. 13, 2018

Related U.S. Application Data

(60) Provisional application No. 62/518,550, filed on Jun. 12, 2017.

(51) Int. Cl.

| | |
|---|---|
| ***B41J 29/38*** | (2006.01) |
| ***B41J 11/00*** | (2006.01) |
| ***B41J 2/045*** | (2006.01) |
| ***B41J 2/21*** | (2006.01) |
| ***B41J 11/46*** | (2006.01) |
| *B41M 3/00* | (2006.01) |

(52) U.S. Cl.

CPC ..... *B41J 11/008* (2013.01); *B41J 2/04586* (2013.01); *B41J 2/2132* (2013.01); *B41J 11/0095* (2013.01); *B41J 11/46* (2013.01); *B41M 3/006* (2013.01)

(58) Field of Classification Search

USPC ..... 347/16

See application file for complete search history.

(56) References Cited

U.S. PATENT DOCUMENTS

2005/0035989 A1* 2/2005 Arakawa ..... B41J 11/46 347/16

* cited by examiner

*Primary Examiner* — Lam S Nguyen

(74) *Attorney, Agent, or Firm* — Tracy M. Helms; Apex Juris, pllc.

(57) ABSTRACT

Scan printing systems and methods for reducing banding artifacts of an image printed on a substrate, including a substrate feeder assembly, a printhead adapted to print an encoder pattern on the substrate, a sensor, and a controller. The controller performs a feedback cycle of positioning the substrate relative to the printhead and instructs the printhead to print a band of the image when the encoder pattern has reached a target position. The controller repeats the feedback cycle of positioning the substrate relative to the printhead and instructs the printhead to print a subsequent band of the image until the entire image is printed on the substrate.

15 Claims, 8 Drawing Sheets

SYSTEMS AND METHODS FOR REDUCING BANDING ARTEFACTS OF AN IMAGE ON A SUBSTRATE

BACKGROUND

The present disclosure relates generally to systems and methods to improve the print quality of scan printing by reducing banding artefacts of an image on a substrate.

An ink jet printer generally includes a mechanism for moving print media along a media path. In scan printing, the printhead carriage typically moves laterally with respect to the print media, making several passes to complete an image printing process. During a scan printing operation, media is moved along the media movement path into a printing position, stopped and then the printhead carriage is moved perpendicular to the media movement path to eject ink droplets onto the media surface to create a band of ink dots, subsequently repositioning the printhead or the media by a defined distance, and then depositing another band of dots. If an error occurs in the media movement, for example as often is the case when printing on fabric, the resulting position of ink droplets on the media will be offset from the intended position, which results in undesired banding artefacts in the printed image. Because the banding artefacts tend to be repeated and parallel, these banding artefacts tend to be visible, reducing the overall quality of the image. For example, where the ink droplets were offset from the intended position, errors may show up as lines, bands, or gaps in the resulting image.

Several solutions have been developed to address the problem of banding artefacts such as move the printhead precisely or, more commonly, the media between scans. For example, some high-quality and finely-tuned machinery may reproducibly move a substrate over a precise distance and avoid banding problem, but the high cost and maintenance demands of such a system are problematic. Some solutions involve the use of a movement-tracking encoder. In those setups, either a radial or linear encoder supplies the system with information about how much a component of the system which is in contact with the media actually moves, the feedback from which allows for more precise movement. This approach is problematic in that it is typically some reporter device, such as a sensor along a refractive strip or spinning disc, that is observed moving rather than the media itself. As such, supplying different media with different stretch properties or thicknesses may result in an error in the media movement. Additionally, such systems need to be re-calibrated for each new type of media used.

Another approach to reduce the printed banding problem is to attach an encoder to the media itself. This is frequently implemented as holes punched into the sides of media at regular intervals, such as some styles of printer paper. The media may be moved directly by interacting gears with the holes, or the media may be moved by some other means and motion monitored by sensors, such as light emitters on one side of the column of holes and a photo-sensor on the other side. A notable cost of this method is that media must be modified prior to printing, which in turn raises media prices and reduces the choice of compatible media to the consumer.

The technique of multiple printing passes during which image ink droplets are overlapped has been used to reduce the appearance of media feed error. However, this technique increases printing time for a given image because of the number of printing scans required. Another method of introducing a random minute vibration between the printhead and the media during a printing pass has been used to reduce the banding artefacts. However, these approaches tend to decrease the overall resolution quality of the printed image.

Thus, there clearly exists a need to improve the image quality of images printed by scan printing.

SUMMARY

The present disclosure solves these and other problems by utilizing the printhead's existing ability to create images and print an encoder pattern directly onto the media. The spacing of the encoder pattern is determined by and proportional to the spacing of the individual nozzles of the printhead. The pattern is then analyzed by a sensor to monitor media movement and allow precise control of the media movement. In addition to advantages such as low-cost implementation and flexibility of input media without prior preparation, the inventive subject matter solves the problem of recalibration for different media types by actively recalibrating motion constantly and thus allowing different media to be supplied to the printer with little user input required.

In an example embodiment, a scan printing system includes a substrate feeder assembly adapted to move the substrate along a substrate moving path, a printing assembly configured to receive image data and including a printhead adapted to print an encoder pattern and a band of the image on the substrate, a sensor configured to detect the encoder pattern on the substrate, and a controller coupled to the substrate feeder assembly, the printhead, and the sensor. The controller is configured to receive position data of the encoder pattern from the sensor and determine a target position for the substrate along the substrate moving path. The controller initiates printing of the image by instructing the printhead to print an encoder pattern and a band of the image on the substrate. The controller performs a feedback cycle for positioning the substrate relative to the printhead. The feedback cycle includes calculating a projected moving distance for the encoder pattern to move along the substrate moving path to reach the target position, directing the substrate feeder assembly to move the substrate over the projected moving distance, receiving new position data of the encoder pattern from the sensor, determining whether the encoder pattern has reached the target position based on the new position data, and repeating the feedback cycle until the encoder pattern reaches the target position. The controller instructs the printhead to print another encoder pattern and another band of the image when the encoder pattern has reached the target position. The controller repeats the feedback cycle of positioning the substrate relative to the printhead until the another encoder pattern reaches a subsequent target position. The controller continues with instructing the printhead to print another encoder pattern and another band on the substrate and repeating the feedback cycle for positioning the substrate relative to the printhead until the desired image is printed on the substrate.

The encoder pattern may include a plurality of objects. Positions of the plurality of objects may be mapped onto an image array of the sensor to calculate the target position and the projected moving distance of the substrate. In some embodiments, the encoder pattern includes a leading object and a lagging object, and the controller calculates the target position based on a distance between the leading object and the lagging object, a width of the printhead, and a scalar value determined by the number of passes used to print each band. In some embodiments, the encoder pattern is printed on the substrate in an area outside of the printed band. In other embodiments, the encoder pattern is part of the band of the image on the substrate. In further embodiments, the encoder pattern may include magnetic marks or electrically conductive marks.

The inventive subject matter is also directed to a scan printing method for reducing banding artefacts of an image on a substrate, including (a) printing an encoder pattern on the substrate; (b) detecting the encoder pattern with a sensor; (c) determining a target position based on position data of the encoder pattern; (d) calculating a projected moving distance of the substrate to reach the target position; (e) moving the substrate by the projected moving distance; (f) detecting a new position of the encoder pattern with the sensor and determining whether the encoder pattern has reached the target position; (g) repeating steps (d)-(f) until the encoder pattern reaches the target position; (h) printing a band of the image; (i) repeating steps (a)-(h) until the desired image is printed on the substrate.

In some embodiments, the encoder pattern and the image are printed on the substrate with a printhead. In other embodiments, the encoder pattern includes a plurality of objects. In further embodiments, positions of the plurality of objects are mapped onto an image array of the sensor to calculate the target position and the projected moving distance of the substrate. In some embodiments, the encoder pattern includes a leading object and a lagging object, and the target position is calculated based on a distance between the leading object and lagging object, a width of the printhead, and a scalar value determined by the number of passes used to print each band. In some embodiments, the encoder pattern may be part of the image or it may be printed on the substrate in an area outside of the printed band. In further embodiments the encoder pattern may include magnetic marks or electrically conductive marks.

This Summary is not intended to limit the scope or meaning of the disclosed subject matter. Further, the Summary is not intended to identify key features or essential features of the disclosed subject matter, nor is it intended to be used as an aid in determining the scope of the disclosed subject matter.

DETAILED DESCRIPTION

Figure 1:
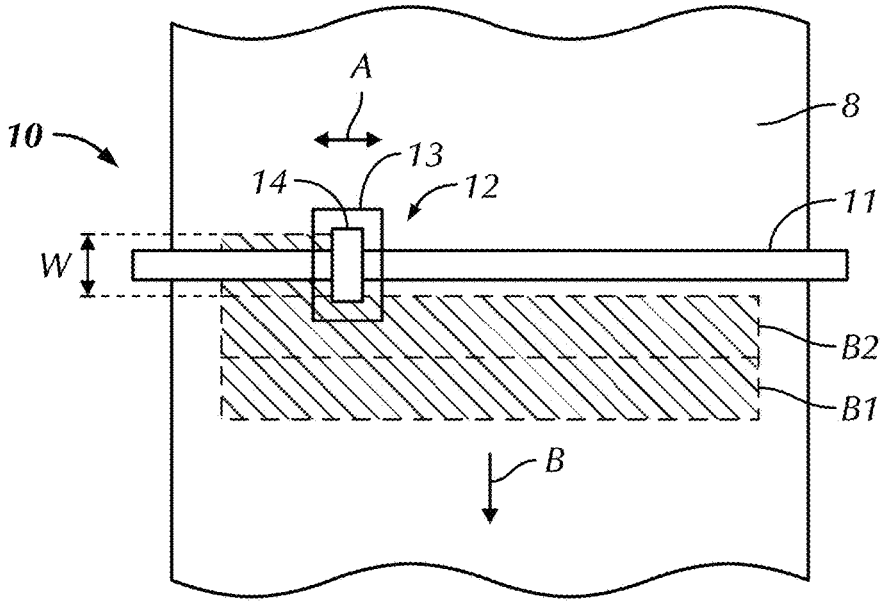
FIG. 1 shows a schematic top view of a printhead and a substrate illustrating the directions of movement of the printhead and the substrate.

The disclosed subject matter will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

The disclosed subject matter provides systems and methods that automatically and dynamically provide calibration features for scan printing on a substrate. The print quality of the resulting image benefits from the auto-calibration features, especially when printed on certain substrates such as fabrics that have tensile properties that can vary in different directions when a substrate is positioned taut prior to a printing operation.

Most scan printers move the media along an axis perpendicular to the movement of the printhead. Alternative scan printer designs can leave the media unmoved and instead move the printhead relative to the media. When the media is not moved, the problem of stretching may partially be eliminated, however the media must still be held in place during printing and points of contact may still introduce stretching of the media. For the embodiments described below, motion of the media is considered to be relative to the position of the printhead. However, the inventive subject matter can be used with systems that move either the printhead or the media relative to an outside observer. If the substrate is stationary, then the printhead would have to move in two dimensions with one dimension forming a band and the second dimension allowing the bands to abut or overlap each other.

The inventive subject matter differs in at least three key respects from conventional systems and methods, for example, by 1) utilizing the printhead's own, existing ability to create marks instead of relying on media with prefabricated marks; 2) taking advantage of the known and predictable relationship between the width of the printhead and the distance that the substrate is desired to be moved with each movement step; and 3) using a sensor that does not move relative to the printhead in the direction of media movement. The feedback of the sensor allows algorithms for determination of media position, which in turn allows a simple repeating motion to result in precise total movement of the substrate.

The advantages the disclosed subject matter confers over existing systems and methods are considerable, and include reduced cost of components, increased reliability, reduced need for manual recalibration and flexibility in consumable media.

As used herein, the terms "substrate" and "media" are used interchangeably and refer to the material that provides the surface on which any suitable ink or dye can be deposited. The type of media used with the inventive subject matter may be any media that can be printed upon using an array of markers such as an inkjet printhead. The exemplary embodiments described below use fabric as the print media, such as cotton or silk. Other types of fabric that can be used include polyester, rayon, nylon, linen and any other suitable material. Some embodiments could use paper as print media. Further embodiments may use plastic, glass, ceramics, circuit boards, stone, or other suitable print media.

The inventive subject matter includes one or more printing elements or an arrangement of printing elements, also referred to as a "printhead" or an "array of markers," for creating marks and images on a substrate, for example an inkjet printhead including an array of inkjet nozzles or a combination of printheads. As used herein, the term "printhead" generally refers to one or more printing elements capable of causing any possible character or symbol, including a single or multi-pixel character or symbol, of any color to be printed on a substrate. In some embodiments, the term "printhead" can also refer to a pen or cartridge.

The desired image can be a two-dimensional pattern or any design that is to be applied to a substrate. The image is formed by a sequence of print zones or bands. A band is typically a horizontal stripe or section of the image created when the printhead passes over the media. As the printhead travels over the substrate along a printhead moving path, it defines a band in which ink droplets are ejected from the printhead onto the substrate. In the embodiments described below, the width of a band corresponds with the width of a printhead.

Figure 8:
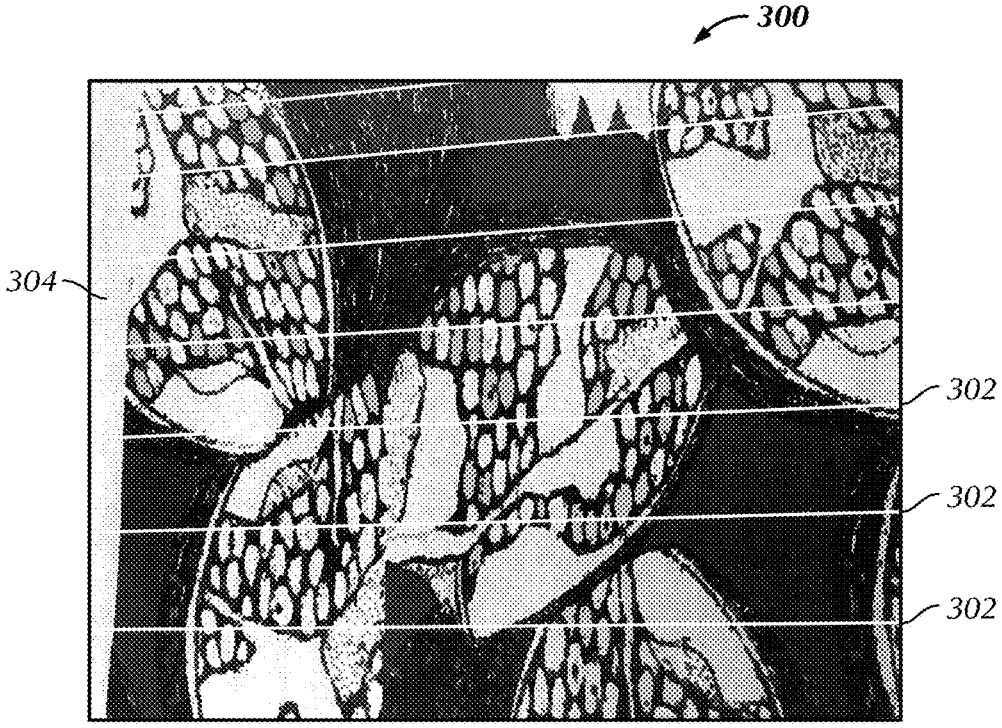
FIG. 8 shows a top view of an image printed on a substrate, the image having banding artefacts as they would occur in an image printed according to a conventional method.
Figure 9:
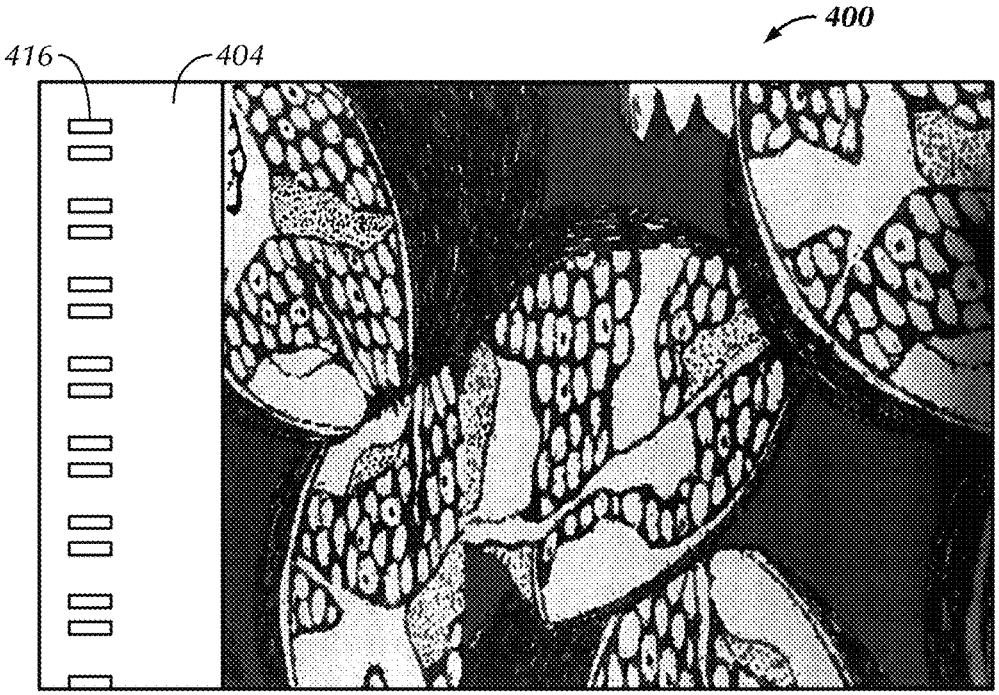
FIG. 9 shows a top view of an image printed on a substrate according to the inventive subject matter.

To illustrate the problem of banding artefacts, FIGS. 8 and 9 provide a visual comparison of the quality of printed images obtained by using a conventional printing method (FIG. 8) versus using the inventive systems and methods disclosed and described herein (FIG. 9). FIG. 8 shows an image 300 wherein horizontal lines, representing banding artefacts 302, are clearly visible after image 300 is printed with conventional methods on fabric media 304. FIG. 9 shows an image 400 printed according to the inventive subject matter with the incorporation of encoder patterns 416 and where no banding artefacts are visible on a substrate 404.

Figure 7:
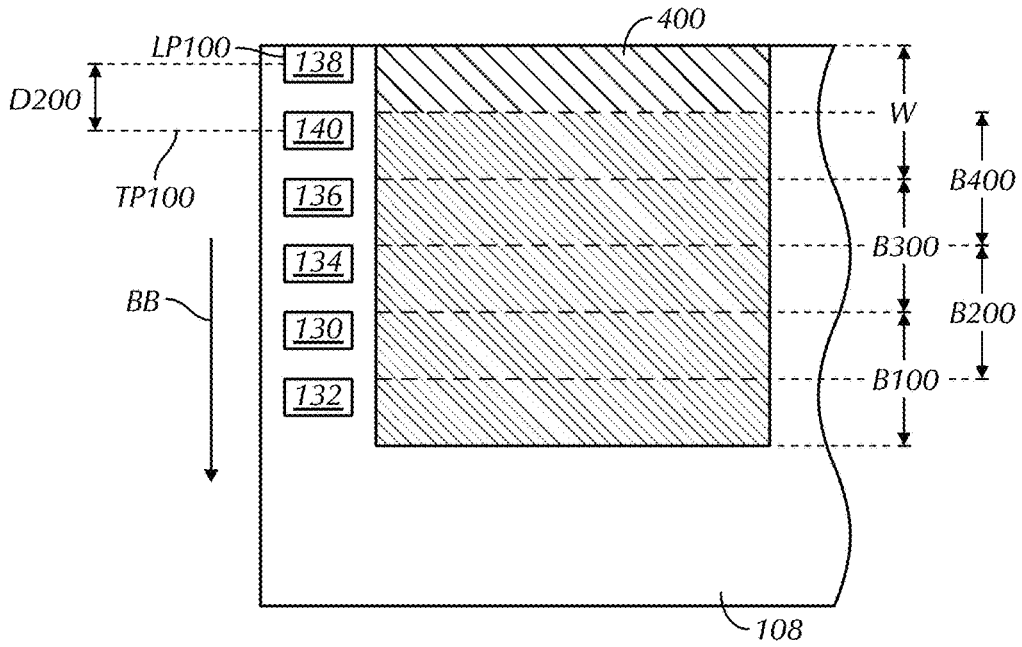
FIG. 7 shows a schematic top view of a substrate including an encoder pattern printed in two overlapping passes of the printhead and the resulting partial image printed as a sequence of multiple bands with overlaps according to a second embodiment of the inventive subject matter.

The inventive subject matter may be used in situations of both single-pass and multiple-pass printing. In single-pass printing, any given spot is only printed once, the total distance that each band is to be moved is equal to the width of the printhead's nozzle array. Printed bands abut each other and do not overlap. In single-pass printing, the quality of the printed image depends on the alignment of the printhead with respect to an immediately prior printed band. In multiple-pass printing, any given spot is printed multiple times, the distance to be moved is a fraction of the width of the printhead's nozzle array, and the printed bands overlap each other. In the first exemplary embodiment, illustrated in FIGS. 1-5 and described below, single-pass printing is employed and the distance to move is equal to the width of the printhead. In the second exemplary embodiment, illustrated in FIGS. 6-7 and described below, two-pass printing is employed and the distance to move is equal to half the width of the printhead.

A first embodiment of the inventive subject matter is described with reference to FIGS. 1-5. FIG. 1 illustrates a printing assembly 12 of a scan printing system 10 and a substrate 8. Printing assembly 12 includes a printhead 14 supported on a printhead carriage 13 which travels along a carriage slide arrangement 11. While printing, printhead 14 moves on carriage slide arrangement 11 along a printhead moving path A that is perpendicular to a substrate movement path B. A single band B1 is printed on substrate 8 upon passing of printhead 14 along printhead moving path A.

Figure 2:
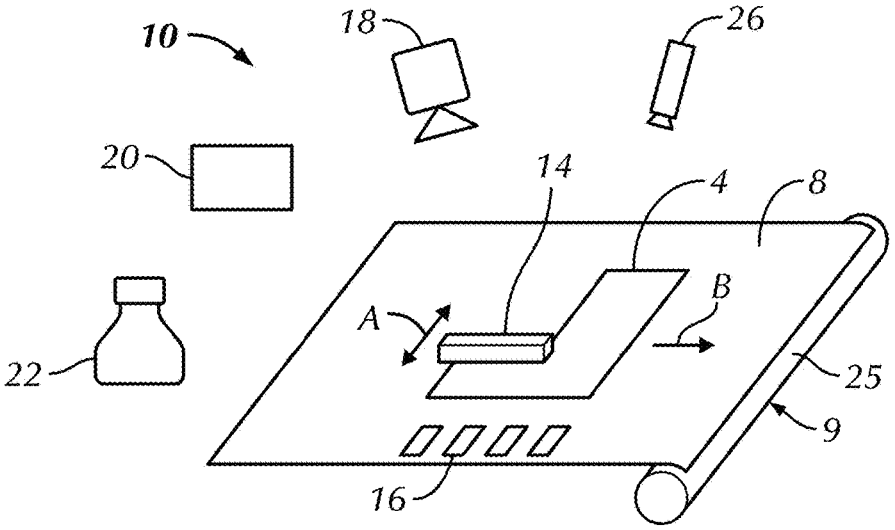
FIG. 2 shows a schematic perspective view of a scan printing system and a substrate with an encoder pattern printed thereon.
Figure 3:
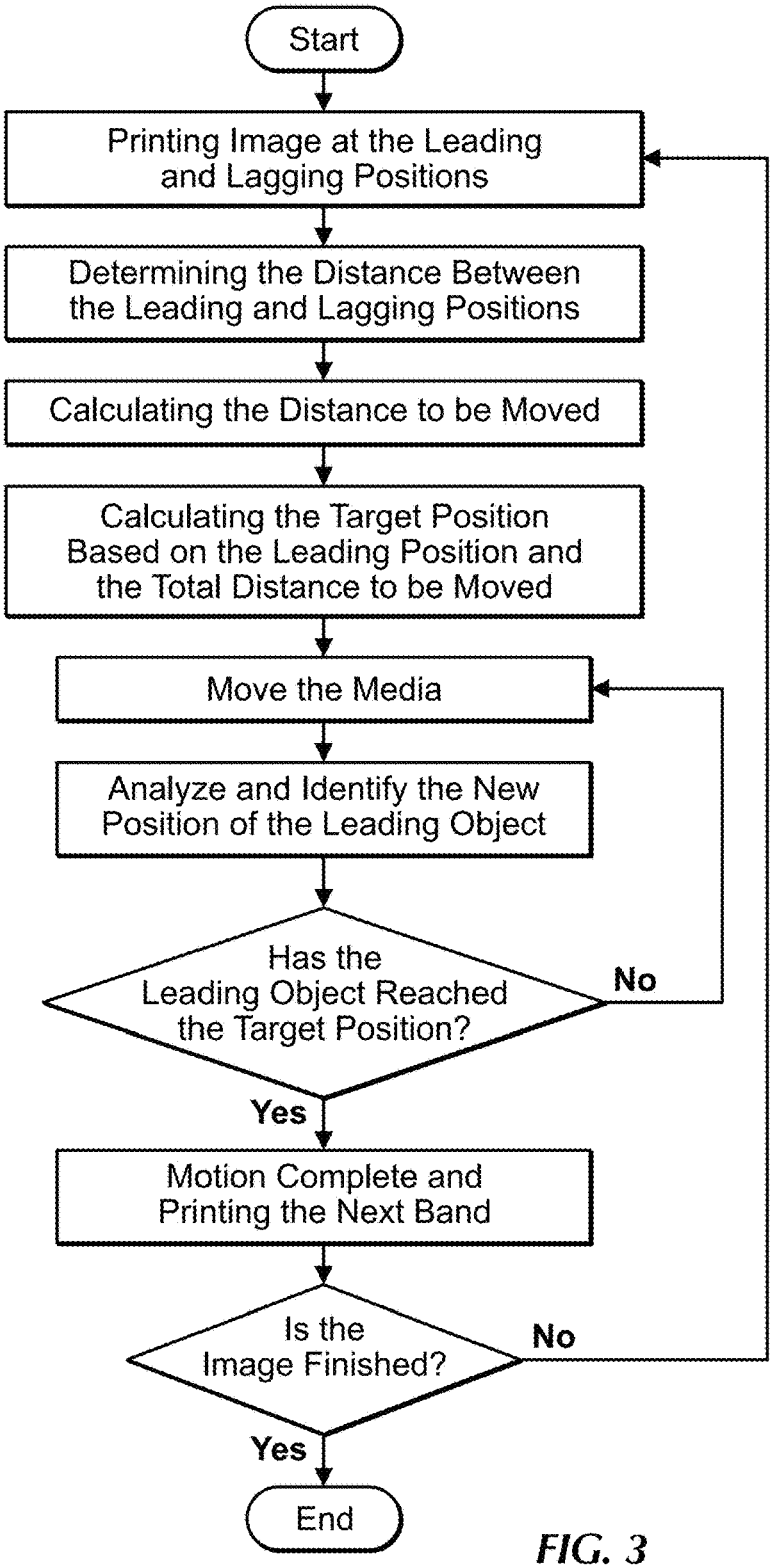
FIG. 3 is a high-level flowchart illustrating steps of a scan printing method including the incorporation of an encoder pattern and the analyzing and controlling of substrate movement to a target position.

FIG. 2 illustrates components, in simplified form and without interconnecting parts, of a scan printing system 10. Scan printing system 10 includes a substrate feeder assembly 9, a printing assembly 12, a sensor 18, and a controller 20. When printing assembly 12 receives image data from controller 20 a printing operation is started by moving printhead 14 along carriage slide arrangement 11. An ink supply 22 is operatively coupled to printhead 14. During the printing of image bands B1, B2, B3, . . . Bn, printhead 14 traverses substrate 8, and each printed band includes an encoder pattern 16 printed on substrate 8 in an area outside to the printed image. Upon completion of printing a band, the printhead travels back along the carriage slide arrangement to its starting position and is ready to print a subsequent band.

To provide optimal positioning of substrate 8 and printhead 14 relative to each other, controller 20 instructs feeder assembly 9 to move substrate 8 based on position data of encoder pattern 16. Controller 20 thereto calculates a target position TP1 corresponding to a position of substrate 8 that is to be reached before initiating printing of a next band.

Controller 20 instructs feeder assembly 9 to move the substrate in the amount of a calculated projected moving distance.

Printing assembly 12 allows printhead 14 to traverse substrate 8 in a substantially horizontal direction during a printing operation. Printhead 14 travels substantially parallel to a surface of substrate 8 while individual nozzles of printhead 14 receive firing instructions from a controller to create a band of the image. For example, a 192-nozzle piezoelectric printhead depositing colored reactive dyes on substrate 8 can be used. In other embodiments, a printhead may include an array with multiple nozzles such as thermal, bubble, electrostatic, or acoustic ink jet printheads. In further embodiments, an array of liquid ejectors, such as compressed air-, solenoid-, or motor-powered pump ejectors may be used, or an array of syringes can be used.

In scan printing system 10, substrate feeder assembly 9 moves substrate 8 along an x-axis perpendicular to the movement of the printhead, for example, via rollers as described below. Motion along a y-axis is accomplished via movement of printhead 14 along carriage slide arrangement 11. Printhead 14 moves along carriage slide arrangement 11 in a substantially horizontal manner over substrate 8; and moves from one side of substrate 8 to another side of substrate 8 while printing a band.

Substrate feeder assembly 9 is adapted to receive substrate 8 and securely move substrate 8 along substrate moving path B to arrive at an optimal position relative to printhead 14. Substrate feeder assembly 9 may include a feed roller 25. Feed roller 25 contacts substrate 8 directly and can be rotated by motors. The substrate may be pulled by the rollers, typically through friction contact between multiple rollers or by adhesive contact to a single roller. In some embodiments, a support roller may guide the supply of substrate to the system and minimizes friction as the substrate is supplied, reducing the power required by the feed motor. In further embodiments, a single roller can be rotated by a stepper motor and the substrate is attached to the roller by an adhesive. In other embodiments, multiple rollers are positioned with the media between them and the media is pulled through the system by the rotation of one or more of the rollers and the resulting friction between the roller surface and the substrate. The substrate may be held taut below the printhead between rollers or other tensioning elements. In further embodiments, the substrate may be supported by a flat surface. For example, the substrate may be supported by an acrylic sheet and tension may be supplied with a roller connected to the media by an adhesive and by a pair of magnetic strips.

In the example embodiments described herein, the substrate can be a sheet of fabric which is manually attached to one or more rollers and automatically fed below the printhead during printing. In the illustrative embodiments, a cotton sheet of about 54 inches wide and 108 inches long is used. Dimensions are given for illustrative purposes and are not intended to be limiting in any way. In some embodiments, a printing assembly of 60 inches wide could feed fabric of up to 57 inches wide. In other embodiments, a printing assembly of 40 inches wide could feed fabric of up to 37 inches wide. Some embodiments, allow a user to load custom-cut pieces of fabric. Other embodiments can be adapted to feed rolls of fabric.

For each printed band, encoder pattern 16 is formed by two objects 30, 32, having a solid black color and rectangular shape. Objects 30 and 32 are printed in a margin along an edge of substrate 8 to the side of the printed image where the printhead starts with printing the band. Encoder pattern 16 has the benefit that the pattern is easy to detect via sensors, that it provides clearly visible reference points, and thereby reduces detection error rates by the sensor. However, in other embodiments the encoder pattern can include a single object or a plurality of objects in any shape, pattern, or location that is detectable by a sensor. The shape of the encoder pattern influences the ease and precision with which the objects can be detected by the sensor and reduces the chances of identifying false positive objects. In some embodiments, multiple objects can be identified by both their size and spacing from one another. For example, a barcode can include tens or hundreds of rectangles conveying information based on rectangle width and spacing. In further embodiments, the encoder pattern can be printed in any detectable color by using ink that is already available for printing the image. In yet other embodiments, an encoder pattern can be embedded into the printed image and can be an integral part of the printed image.

Scan printing system 10 uses a sensor 18 to detect encoder pattern 16 on substrate 8. In the illustrative embodiment, sensor 18 is stationary and focused on the area of the substrate whereon encoder pattern 16 is printed, and is adapted to recognize a specific encoder pattern. In some embodiments, a single dimension of a camera may be employed as an inexpensive and readily available optical sensor array, for example using a single row of pixels in a two-dimensional image or an array of imaging sensors such as a linear or one-dimensional array of sensors parallel to the direction of media movement. Positions of objects can be mapped onto the image array to calculate the target position TP and the projected moving distance of the substrate.

In other embodiments, a digital camera with a two-dimensional array of optical sensors can be used to detect the objects. A two-dimensional image can be acquired with a digital camera and the intensity values of each column, i.e., in a direction perpendicular to the media movement, are summed. The resulting one-dimensional array of summed values can be used to determine objects' positions. For example, a model GH2220 printhead supplied by Ricoh Company, Ltd. and a model UC-246 digital camera board with an Omnivision OV7670 CMOS image sensor can be used.

In other embodiments, the printed objects can be identified with sensors and their position determined by which sensor(s) in the array are activated. In further embodiments, a linear charge-couple device can be used as the sensor array, for example a barcode scanner. In other embodiments, magnetic marks may be used in conjunction with an array of magnetic sensors. In yet further embodiments, electrically conductive marks can be used in conjunction with an array of conductivity sensors.

Optionally, to enhance contrast and improve detection by the sensor, a light source 26, such as a visible light LED lamp, can be used. In some embodiments, ultraviolet (UV)-visible marks may be used in conjunction with UV lighting and an array of UV sensors. In further embodiments, infrared (IR)-visible marks may be used in conjunction with IR lighting and an array of IR sensors. In some embodiments, electrically conductive ink may be an option, for example, as used in wearable media. Some embodiments may use magnetic ink with associated detectors.

Various steps of a printing method according to a first embodiment of the inventive subject matter are explained with reference to FIG. 3, FIGS. 4A-E, and FIG. 5. The calculations of how far substrate 8 is to be moved along substrate moving path B and when to stop substrate movement are performed by controller 20. To coordinate the printing operation, controller 20 is coupled to substrate feeder assembly 9 and printing assembly 12. Sensor 18 sends position data of encoder pattern 16 to controller 20. Controller 20 determines target position TP1 for encoder pattern 16 and performs a feedback cycle of positioning substrate 8 relative to printhead 14. The feedback cycle is repeated until encoder pattern 16 reaches target position TP1. When encoder pattern 16 has reached target position TP1, controller 20 instructs printhead 14 to print a band, for example band B1 of the image. The entire printing cycle is repeated until the desired image is printed on the substrate.

Encoder pattern 16 consists of two rectangular objects, referred to as leading object 30 and lagging object 32. The object in the direction counter to the media movement is referred to as leading object 30, while the object in the direction of the media movement is referred to as lagging object 32. Positions of objects 30 and 32 are analyzed by a sensor, for example a linear digital array of phototransistors with 200 sensors could detect the two objects at positions 40 to 60 and 80 to 100.

Figure 4A:
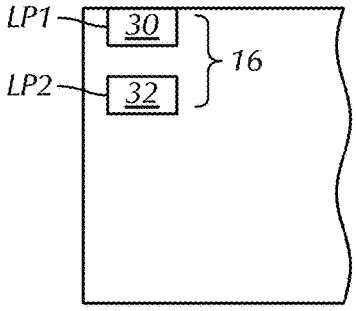
FIG. 4A shows a schematic top view of a substrate including an encoder pattern printed with a single pass of the printhead and illustrating the step of locating objects according to a first embodiment of the inventive subject matter.
Figure 4B:
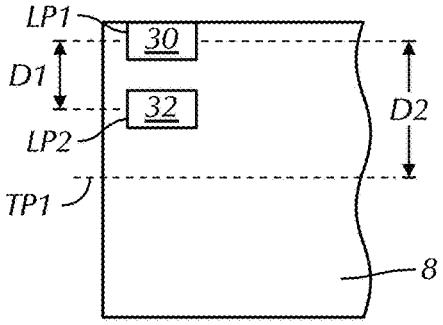
FIG. 4B shows a schematic top view of a substrate including an encoder pattern printed with a single pass of the printhead illustrating the step of calculating distances.
Figure 5:
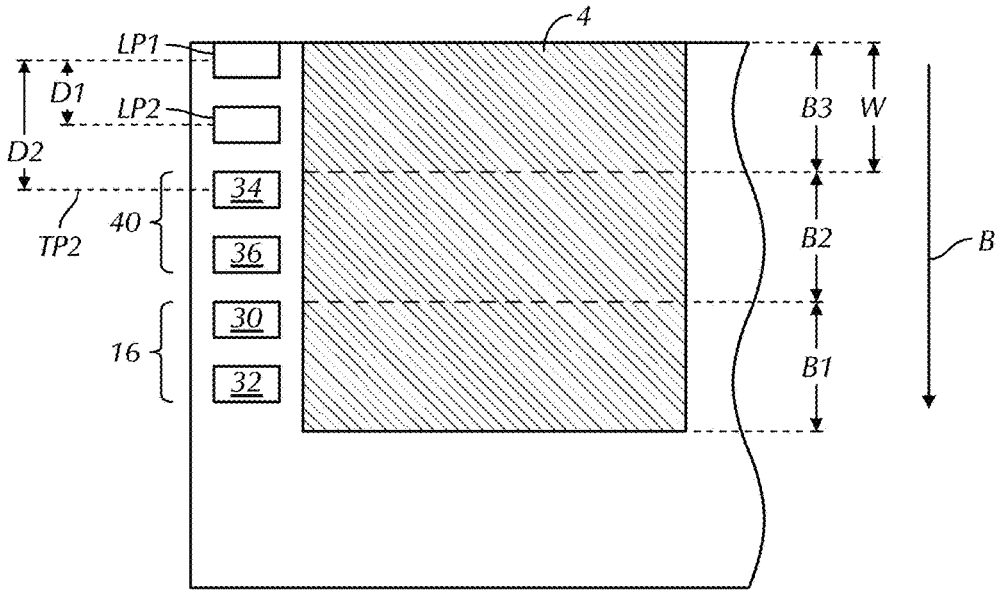
FIG. 5 shows a schematic top view of a scan printing system illustrating an image printed as a sequence of multiple bands without overlaps between bands.
Figure 6A:
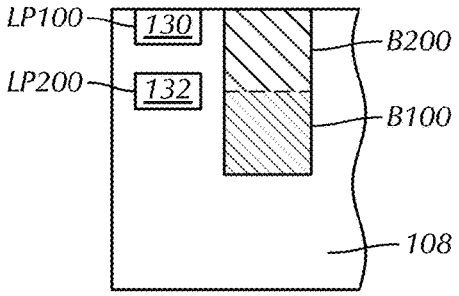
FIG. 6A shows a schematic top view of a substrate including an encoder pattern and illustrates steps of locating objects and wherein each band of the image is printed in two overlapping passes of the printhead according to a second embodiment of the inventive subject matter.
Figure 6B:
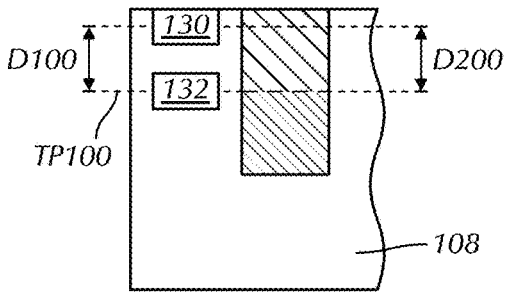
FIG. 6B shows a schematic top view of a substrate including an encoder pattern printed in two overlapping passes of the printhead illustrating the step of calculating distances according to a second embodiment of the inventive subject matter.
Figure 6C:
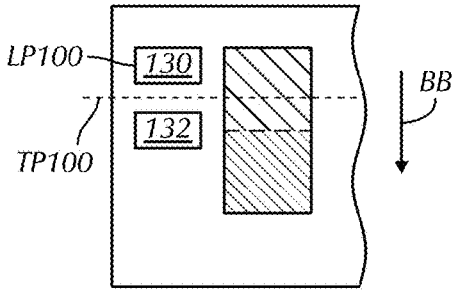
FIG. 6C shows a schematic top view of a substrate including an encoder pattern printed in two overlapping passes of the printhead illustrating the step of moving the substrate and reanalyzing the distance moved by the substrate according to a second embodiment of the inventive subject matter.
Figure 6D:
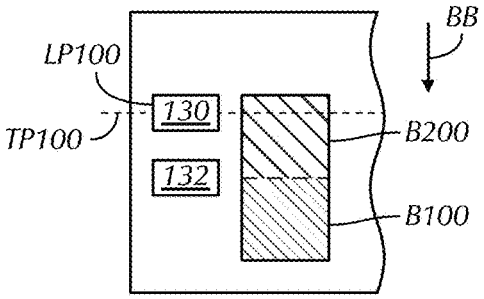
FIG. 6D shows a schematic top view of a substrate including an encoder pattern printed in two overlapping passes of the printhead illustrating the step wherein the leading position reaches the target position and the motion of the substrate is complete according to a second embodiment of the inventive subject matter.
Figure 6E:
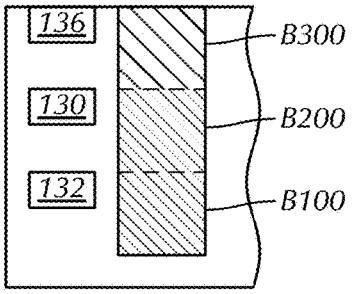
FIG. 6E shows a schematic top view of a substrate including an encoder pattern printed in two overlapping passes of the printhead illustrating the step wherein the next band is printed on the substrate including a subsequent encoder pattern according to a second embodiment of the inventive subject matter.

A preparatory step of the printing method is illustrated in FIG. 4A. After a user positions the substrate in a starting position, an encoder pattern 16 is created as part of band B1 in a single pass of printhead 14 over substrate 8. Upon external input, the controller instructs the printhead to print encoder pattern 16 including leading object 30 and lagging object 32, Subsequently, leading object 30 and lagging object 32 are detected by sensor 18. Controller 20 receives position data of leading object 30 and lagging object 32 from sensor 18. The position of objects 30 and 32 may be calculated from the raw optical sensor information by various algorithms. In the exemplary embodiments, the edges of the objects are determined based on the difference between the data from adjacent sensors. In other embodiments, the product of the darkness values of each observing sensor and the sensor's location on the visual array for each sensor may be summed, and an average value calculated by dividing this sum by the total number of sensors. The position calculated for each object may represent one of several locations on the object, as long as the relative location is consistent from calculation to calculation. As illustrated in FIGS. 4B and 5, the center of the objects is used as the determinative position. In other embodiments, the top or bottom of the object may be used as its determinative position. In further embodiments, a single object may be printed in place of distinct leading and lagging objects and the top and bottom of that single object can be used as the leading and lagging positions.

The distance between the two objects may be calculated from various points in the two objects. In the example embodiment, the center points of the two objects could be calculated as positions 50 and 90. The distance between them would then be 90 minus 50 which equals 40. In this example, the projected moving distance to reach the target position is twice the distance between the leading and lagging positions, or 40×2=80 units. The distance between objects 30 and 32, which in this case is the distance between the rectangles' centers, is calculated in terms of the number of image sensing elements between the objects, for example the number of pixels between the objects when imaged by a digital camera, and the projected moving distance D2 to reach target position TP1, i.e., the destination, is calculated.

Objects 30 and 32 can be created with specific dedicated nozzles in printhead 14. For example, an inkjet printhead including 96-nozzles can generate two rectangles by activating nozzles 1 to 24 and 49 to 72. Hence, distance D1 between objects 30 and 32 is known and a projected moving distance D2 for encoder pattern 16 to reach target position TP1 can be calculated. In other words, a target position is a position where two bands would overlap or abut so that there is not gap in between subsequent bands or unintentional overlap of bands.

After the preparatory step, distance D2 that must be moved with each pass of printhead 14 is known relative to the sensors in the sensor array. The preparatory step may be executed once and a single distance value used repeatedly, or it may be repeated for each band of printing.

A value for target position TP1 is calculated as the location of the object at the leading position plus the distance to be traveled. The distance to be traveled is in turn determined as the product of the physical width W of a printhead and a scalar value determined by the number of passes used to print each band. This scalar value may be greater than, equal to, or less than one depending on the situation and need not be an integer. For example, scalar values of 0.4, 1, 1.25, or 5 may be appropriate in various circumstances.

For single-pass printing, the distance to be traveled is the physical width of the printhead. The scalar value is derived by dividing the ratio of the projected moving distance D2 over the distance between objects D1, by the number of passes. In the first example embodiment, the ratio of the projected moving distance D2 over the distance between objects D1 is two. The number of passes to print a band of the image is one. This results in a scalar value of 2. For example, if the center point of leading object 30 at location LP1 is identified as position 50 on a sensor array, then a target position would be calculated as 50 plus 80 leading to position 130 on the sensor array. The value that must be added to the leading object position, i.e., the distance to be moved, is calculated as described below. The target position may be calculated only once at the preparatory step or recalculated during each pass of printing. Based on the calculations of the controller, substrate 8 is moved relative to printhead 14, as illustrated in FIGS. 4B, 4C and 4D.

In the example embodiment described herein, the controller is a microprocessor, such as an ARM Cortex M3 on an Arduino Due board and is programmed in the C++ programming language. Controller 20 communicates with sensor 18 via wires to order an image to be taken and to receive data. In this case, the microprocessor is a distinct component from the camera and is connected to the camera by copper wires and through other simple electrical components such as resistors and capacitors. Controller 20 may also control motors that drive substrate feeder assembly 9 to move substrate 8. In this example, no remote computer is involved in the calculations for media movement. However, some embodiments may use wireless connections.

Figure 4C:
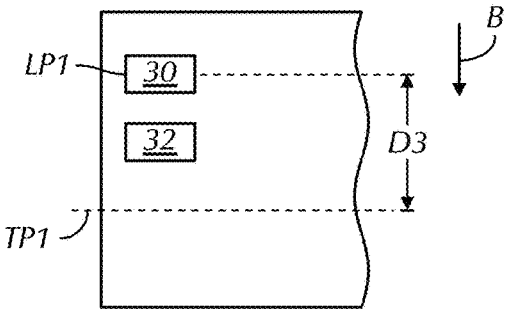
FIG. 4C shows a schematic top view of a substrate including an encoder pattern printed with a single pass of the printhead illustrating the step of moving the substrate and reanalyzing the distance moved by the substrate.
Figure 4D:
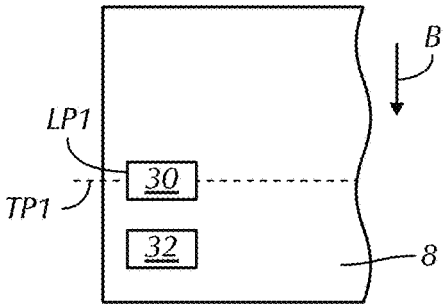
FIG. 4D shows a schematic top view of a substrate including an encoder pattern printed with a single pass of the printhead illustrating the step wherein the leading position reaches the target position and the motion of the substrate is complete.

After substrate 8 has moved, the location of leading object 30 at leading position LP1 is re-analyzed and a distance D3 to reach target position TP1 is calculated, as illustrated in FIG. 4C. The feedback cycle of positioning substrate 8 relative to printhead 14 is repeated until object 30 of encoder pattern 16 has reached target position TP1, as shown in FIG. 4D, or is positioned within a predetermined error distance. Once object 30 has reached target position TP1, the printhead proceeds to print another band B2 including a new encoder pattern 40.

Figure 4E:
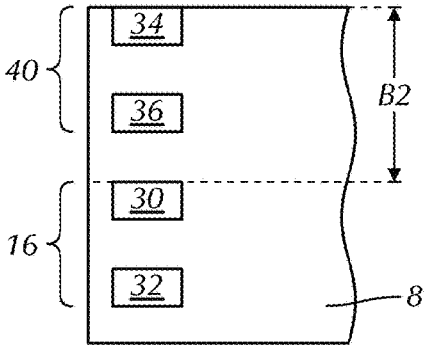
FIG. 4E shows a schematic top view of a substrate including an encoder pattern printed with a single pass of the printhead illustrating the step wherein the next band is printed on the substrate including a subsequent encoder pattern.

As illustrated in FIGS. 4E and 5, when sensor 18 detects a new encoder pattern 40 on substrate 8, controller 20 determines a new target position TP2 based on position data of leading object 34 and lagging object 36 and repeats the feedback cycle of positioning substrate 8 until new encoder pattern 40 reaches new target position TP2. The new position of leading object 34 is analyzed to determine if leading object 34 has reached new target position TP2. If target position TP2 has not been reached yet, substrate 8 is moved again. The cycle is repeated until leading object 34 has reached target position TP2. When target position TP2 is reached controller 20 instructs printhead 14 to print a subsequent band B3 of image 4. The system continues printing subsequent bands B1, B2, B3, . . . Bn of image 4 based on newly detected encoder patterns, newly calculated target positions, and repositioning of the substrate. For each band, the positions are calculated, tracked, and moved, and a part of the image is printed. The process is repeated until the whole image is completely rendered on substrate 8 with the bands bordering directly to one another, and encoder patterns along a side edge of the substrate.

In each step of movement, only detection and position of the leading object is used for analysis. Hence, in some embodiments, the lagging object may not be reproduced at all after the preparatory step.

For any implementation of the disclosed methods, a relationship must be determined between the total width of a printhead, and the distance between individual objects of the encoder pattern. In the example above, a 96-nozzle wide printhead produced two objects which are each 24 nozzles wide. The center-to-center distance between them may be calculated as 48 nozzles. For single-pass printing, the printhead would have to move a distance equal to the width of the printhead for each round of printing. In the example above, this would require movement equal to the spacing of the 96-nozzles. As the two printed objects are 48 nozzles apart, the total distance to be moved may be calculated as two times the distance between the printed objects. The scalar value would thus be two, derived as described above. In terms of the location in the array of sensors, the total distance to be moved is the distance between the center of the objects, or 40 sensors, times two, which is 80 sensors in total.

In other embodiments, distinct bands may overlap to create an image by multi-pass printing. For example, FIGS. 6A-E and 7 illustrate a second example embodiment of the inventive subject matter wherein each band of the image is printed in two passes. In this embodiment, an image 400 is formed of subsequent bands B100, B200, B300, B400 . . . . A single band, for example band B200, is printed on substrate 108 upon passing of a printhead along a printhead moving path, however, each band, for example band B200, overlaps partially with a prior printed band, for example, band B100. The distance D200 to move substrate 108 along a substrate moving path BB is equal to half the width of the printhead. The distance between leading object 130 and lagging object 132 is the distance D100.

The location of target TP100 is calculated as the product of the distance between leading object 130 and lagging object 132 and a predetermined scalar value. As explained above, the scalar value is calculated as the distance to move per pass divided by the known distance between the inkjet nozzles used to create the two objects. Objects 130 and 132 are spaced at a distance of half the width of the printhead and a scalar value of 1 is used in conjunction with two-pass printing. This is derived by dividing the ratio of D2 over D1, which is 2, by the number of passes, which is 2, for a result of 1 for the scalar value.

In another embodiment, the objects can be spaced at a distance of 75% of the printhead width and a scalar value of 1.33 is used in conjunction with single pass printing. In yet another embodiment, the objects can be spaced at a distance of 25% of the printhead width and a scalar value of 4 is used in conjunction with single pass printing. In a further embodiment, the objects can be spaced at a distance of 25% of the printhead width and a scalar value of 1 is used in conjunction with four-pass printing.

The projected moving distance, i.e., distance moved per step, is typically a value that is less than the distance to be moved, especially when the printer in question lacks the capability of moving the print media backwards. This value may be variable or fixed. Larger values result in fewer steps and thus faster printing, at the cost of lower resolution and thus lower image quality. In the exemplary embodiments, the printing system lacks the capability of moving the print media backwards and moves approximately 70% of the estimated remaining distance in each step until the distance is less than 5% of the total distance to be moved, at which point a small fixed value is moved in each step equivalent to approximately 0.5% of the total distance to be moved. In other embodiments, a fixed value can be moved in each step, for example 5% of the total distance to be moved. In further embodiments, a step of defined size is taken and the actual distance remaining to be moved is calculated, with subsequent step sizes being altered based on this calculation.

The inventive subject matter also contemplates embodiments of a standalone system. For example, the sensor array and printing array may or may not be integrated directly into the electronics of the overall printing device. In the exemplary embodiments described above, the sensor and the printhead are each directly connected and controlled by the controller which also controls all other functions of the printer, such as motion and user interface. In other embodiments, the sensor can be controlled by a distinct controller which processes the sensor data and forwards simple commands to a main controller, for example whether to move or not. In that case, the sensor and controller could form a distinct device that is manufactured separately from the rest of the printer and added to existing printer designs to allow for fine motion control.

The scan printing system may also include a customized ink supply, for example ink optimized for certain substrates. In some embodiments, the scan printing system may include dedicated computer software. For example, a software package may be operatively coupled to the printing assembly allowing customization of images by a user.

Specific embodiments disclosed and illustrated above are not to be considered in a limiting sense as numerous variations and combinations are possible. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub-combinations of the disclosed inventions that are believed to be novel and non-obvious. Inventions embodied in other combinations and sub-combinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A scan printing system for reducing banding artefacts of an image printed on a substrate, the scan printing system comprising:

a substrate feeder assembly adapted to move the substrate along a substrate moving path;

a printing assembly configured to receive image data and including a printhead adapted to print an encoder pattern and a band of the image on the substrate;

a sensor configured to detect the encoder pattern on the substrate; and a controller coupled to the substrate feeder assembly, the printhead, and the sensor, and the controller configured to receive position data of the encoder pattern from the sensor and determine a target position for the substrate along the substrate moving path;

wherein the controller initiates printing of the image by instructing the printhead to print an encoder pattern and a band of the image on the substrate;

wherein the controller performs a feedback cycle for positioning the substrate relative to the printhead, the feedback cycle including calculating a projected moving distance for the encoder pattern to move along the substrate moving path to reach the target position, directing the substrate feeder assembly to move the substrate over the projected moving distance, receiving new position data of the encoder pattern from the sensor, determining whether the encoder pattern has reached the target position based on the new position data, and repeating the feedback cycle until the encoder pattern reaches the target position;

wherein the controller instructs the printhead to print another encoder pattern and another band of the image when the encoder pattern has reached the target position;

wherein the controller repeats the feedback cycle of positioning the substrate relative to the printhead until the another encoder pattern reaches a subsequent target position;

wherein the controller continues with instructing the printhead to print another encoder pattern and another band on the substrate and repeating the feedback cycle for positioning the substrate relative to the printhead until the desired image is printed on the substrate; and wherein the encoder pattern includes a leading object and a lagging object, and wherein the controller calculates the target position based on a distance between the leading object and the lagging object, a width of the printhead, and a scalar value determined by the number of passes used to print each band.

2. The scan printing system of claim 1, wherein the encoder pattern includes a plurality of objects.

3. The scan printing system of claim 2, wherein positions of the plurality of objects are mapped onto an image array of the sensor to calculate the target position and the projected moving distance of the substrate.

4. The scan printing system of claim 1, wherein the encoder pattern is printed on the substrate in an area outside of the printed band.

5. The scan printing system of claim 1, wherein the encoder pattern is part of the band of the image on the substrate.

6. The scan printing system of claim 1, wherein the encoder pattern includes magnetic marks.

7. The scan printing system of claim 1, wherein the encoder pattern includes electrically conductive marks.

8. A scan printing method for reducing banding artefacts of an image on a substrate, the method comprising:

(a) printing an encoder pattern on the substrate;

(b) detecting the encoder pattern with a sensor;

(c) determining a target position based on position data of the encoder pattern;

(d) calculating a projected moving distance of the substrate to reach the target position;

(e) moving the substrate by the projected moving distance;

(f) detecting a new position of the encoder pattern with the sensor and determining whether the encoder pattern has reached the target position;

(g) repeating steps (d)-(f) until the encoder pattern reaches the target position;

(h) printing a band of the image;

(i) repeating steps (a)-(h) until the desired image is printed on the substrate; and wherein the encoder pattern includes a leading object and a lagging object, and wherein the target position is calculated based on a distance between the leading object and lagging object, a width of the printhead, and a scalar value determined by the number of passes used to print each band.

9. The scan printing method of claim 8, wherein the encoder pattern and the image are printed on the substrate with a printhead.

10. The scan printing method of claim 8, wherein the encoder pattern includes a plurality of objects.

11. The scan printing method of claim 10, wherein positions of the plurality of objects are mapped onto an image array of the sensor to calculate the target position and the projected moving distance of the substrate.

12. The scan printing method of claim 8, wherein the encoder pattern is printed on the substrate in an area outside of the printed band.

13. The scan printing method of claim 8, wherein the encoder pattern is part of the band of the image on the substrate.

14. The scan printing method of claim 8, wherein the encoder pattern includes magnetic marks.

15. The scan printing method of claim 8, wherein the encoder pattern includes electrically conductive marks.

* * * * *